US009571915B2

(12) United States Patent
Johansson et al.

(10) Patent No.: US 9,571,915 B2
(45) Date of Patent: Feb. 14, 2017

(54) HEADSET EQUIPPED WITH MATERIAL THAT CAN CHANGE IN SIZE

(71) Applicant: Sony Corporation, Tokyo (JP)

(72) Inventors: Magnus Johansson, Dösjebro (SE); Alexander Hunt, Tygelsjö (SE)

(73) Assignees: Sony Corporation, Tokyo (JP); Sony Mobile Communications Inc., Tokyo (JP)

( * ) Notice: Subject to any disclaimer, the term of this patent is extended or adjusted under 35 U.S.C. 154(b) by 144 days.

(21) Appl. No.: 14/412,967

(22) PCT Filed: Jan. 7, 2014

(86) PCT No.: PCT/IB2014/058102

§ 371 (c)(1),
(2) Date: Jan. 5, 2015

(87) PCT Pub. No.: WO2015/104581

PCT Pub. Date: Jul. 16, 2015

(65) Prior Publication Data

US 2016/0277825 A1 Sep. 22, 2016

(51) Int. Cl.
*H04R 1/10* (2006.01)

(52) U.S. Cl.
CPC ..... *H04R 1/1041* (2013.01); *H04R 1/10* (2013.01); *H04R 1/105* (2013.01); *H04R 1/1008* (2013.01);
(Continued)

(58) Field of Classification Search
CPC ... H04R 25/60; H04R 25/65; H04R 2225/023; H04R 2225/025; H04R 2460/13; H04R 1/1016; H04R 1/105
(Continued)

(56) References Cited

U.S. PATENT DOCUMENTS 8,320,601 B2 11/2012 Takigawa et al.
2005/0157893 A1* 7/2005 Pelrine ..... B64C 3/48 381/190
(Continued)

FOREIGN PATENT DOCUMENTS

WO 2009158624 A1 12/2009
WO 2011001012 A1 1/2011

OTHER PUBLICATIONS

Able Planet headphones, headsets and SoundFit technology. 5 pages. Product information viewed online Jan. 6, 2015, Jan. 8, 2015, and Nov. 20, 2013 at http://www.ableplanet.com.
(Continued)

*Primary Examiner* — Suhan Ni
(74) *Attorney, Agent, or Firm* — Coats & Bennett, P.L.L.C.

(57) ABSTRACT

A headset equipped with one or more materials that can change in size to facilitate the wearing experience by the user. The change in size may provide for a more accurate fit for the user to prevent or reduce the likelihood of the headset inadvertently moving away from the user's ear (e.g., falling out from the ear canal). The changeable size may also be used to convey aspects of the received sound to provide a more powerful listening experience. The material may be constructed from an electroactive polymer that changes in size when stimulated by an electric field. The headset includes a controller with an input for a user to control the size of the material.

12 Claims, 8 Drawing Sheets

(52) U.S. Cl.
CPC ..... *H04R 1/1016* (2013.01); *H04R 1/1091* (2013.01); *H04R 2460/15* (2013.01)

(58) Field of Classification Search
USPC ..... 381/322, 324, 328, 380–381
See application file for complete search history.

(56) References Cited

U.S. PATENT DOCUMENTS

| | | | | |
|---|---|---|---|---|
| 2008/0299339 | A1* | 12/2008 | Keady | A61F 11/08 181/135 |
| 2009/0103763 | A1* | 4/2009 | Petef | H04R 1/1016 381/380 |
| 2010/0172531 | A1 | 7/2010 | Burns | |
| 2011/0103631 | A1 | 5/2011 | Fyke et al. | |
| 2013/0163793 | A1* | 6/2013 | Chen | H04R 1/025 381/190 |
| 2013/0177183 | A1* | 7/2013 | Chen | H04R 1/06 381/190 |

OTHER PUBLICATIONS

International Search Report mailed Oct. 9, 2014 in re International Application No. PCT/IB2014/058102 filed Jan. 7, 2014. European Patent Office, Rijswijk, NL.

Author unlisted. "Electroactive polymers help listeners 'feel' sound." Online publication Jun. 4, 2013. PlasticsNews. Accessed Jan. 5, 2015, at http://www.plasticsnews.com/article/20130604/NEWS/130609980.

* cited by examiner

HEADSET EQUIPPED WITH MATERIAL THAT CAN CHANGE IN SIZE

TECHNICAL FIELD

The present application is directed to headsets equipped with a material that may be expanded and contracted depending upon an input from the user and, more particularly, to headsets equipped with one or more electroactive polymers.

BACKGROUND

Headsets are becoming more popular today as society continues to integrate electronic devices into everyday life. Headsets are worn in a variety of different contexts, including but not limited to when a user is on a call, when listening to music, and when the user is listening to a program through the Internet or television. Further, persons may use headsets in a variety of different settings, including but not limited to at their office at work, in their homes, when at a restaurant or coffee shop, when driving in their car, and when walking or running.

One issue with existing headsets is they are sized to be generic to fit a wide variety of users. This often results in the earpieces that go into or over the user's ears while not properly fitting the user. This results in the earpieces being uncomfortable when on the user's ears, or possibly even moving away from the user's ears (e.g., an earpiece falling out of the user's ear canal). This is particularly problematic when the user is actively moving, such as when the headset is worn while the user is exercising at a gym or walking.

Another issue with existing headsets if they are passive devices that simply fit onto the user's ears and contact against the user. Because headsets are a conduit for conveying the sound to the user, the headsets could be configured in a manner to enhance the listening experience. This is particularly applicable when the user is wearing the headset while listening to music or a movie.

SUMMARY

The present application is directed to a headset system configured to improve the experience for the user. The headset system includes one or more earpieces that include an electroactive polymer (EAP). The EAP is configured to change size upon the application of an electric field. The EAP may be used to adjust the size of the one or more earpieces according to an input from the user. The EAP may be adjusted to emphasize an audio signal, such as to emphasize a beat to music.

One embodiment is directed to a headset system and includes an earpiece with a body configured to be placed at an ear of a user with the earpiece including an electroactive polymer. A controller is electrically connected to the earpiece and includes a control circuit, an energy storage device, an input device configured to receive an input from the user, and a switch operatively connected to the control circuit. The controller is configured to adjust the switch in response to the input received from the input device to selectively use the energy storage device to apply an electrical field to the electroactive polymer to adjust a size of the electroactive polymer between first and second sizes. The electroactive polymer is adjustable between the first size prior to the application of the electrical field and the second size after the application of the electrical field with the second size being larger than the first size.

The headset system may also include a wireless transceiver configured to wirelessly receive audio input signals.

The entire earpiece may be constructed from the electroactive polymer.

The electroactive polymer may be positioned about the earpiece at a plurality of discrete, spaced-apart sections.

The headset system may also include a signal-to-sound converter positioned in the earpiece and configured to convert an audio signal to an internal sound that is audible to the user.

The headset system may include that the control circuit is configured to adjust the electroactive polymer to intermediate sizes that are between the first and second sizes.

The headset system may also include an audio processing circuit associated with the control circuit, with the audio processing circuit configured to analyze a frequency of an incoming audio input signal and to activate the switch to apply the electric field to the electroactive polymer when the audio input signal is below a frequency threshold that is set responsive to the input received through the input device. The application of the electric field increases the size of the electroactive polymer from the first size to the enlarged second size.

Another embodiment is directed to a headset system that includes an earpiece with a body configured to be placed at an ear of a user. The earpiece includes an electroactive polymer positioned on an exterior of the earpiece to contact against the user. A controller is electrically connected to the earpiece and includes a control circuit, an energy storage device, an input device configured to receive an input from the user, and a switch operatively connected to the control circuit. The controller is configured to adjust a frequency threshold responsive to the input received through the input device. The controller is also configured to analyze a frequency of an incoming audio input signal and to activate the switch to use the energy storage device to apply an electric field to the electroactive polymer when the audio input signal is below the frequency threshold to increase a size of the electroactive polymer from a first reduced size to an enlarged second size.

The controller may be further configured to apply the electric field to the electroactive polymer responsive to a second input received through the input device to increase the size of the electroactive polymer with the second input being independent from the frequency of the incoming audio signal.

The headset system may include a wireless transceiver configured to wirelessly receive the incoming audio input signals.

The earpiece may be entirely constructed from the electroactive polymer.

The electroactive polymer may be positioned about the earpiece at a plurality of discrete, spaced-apart sections.

The control circuit may be configured to adjust the electroactive polymer to intermediate sizes that are between the first and second sizes.

The various aspects of the various embodiments may be used alone or in any combination, as is desired.

DETAILED DESCRIPTION

The present application is directed to a headset equipped with one or more materials that can change in size to facilitate the wearing experience by the user. The change in size may provide for a more accurate fit for the user to prevent or reduce the likelihood of the headset inadvertently moving away from the user's ear (e.g., falling out from the ear canal). The changeable size may also be used to convey aspects of the received sound to provide a more powerful listening experience. The material may be constructed from an electroactive polymer that changes in size when stimulated by an electric field. The headset includes a controller with an input for a user to control the size of the material.

Figure 1:
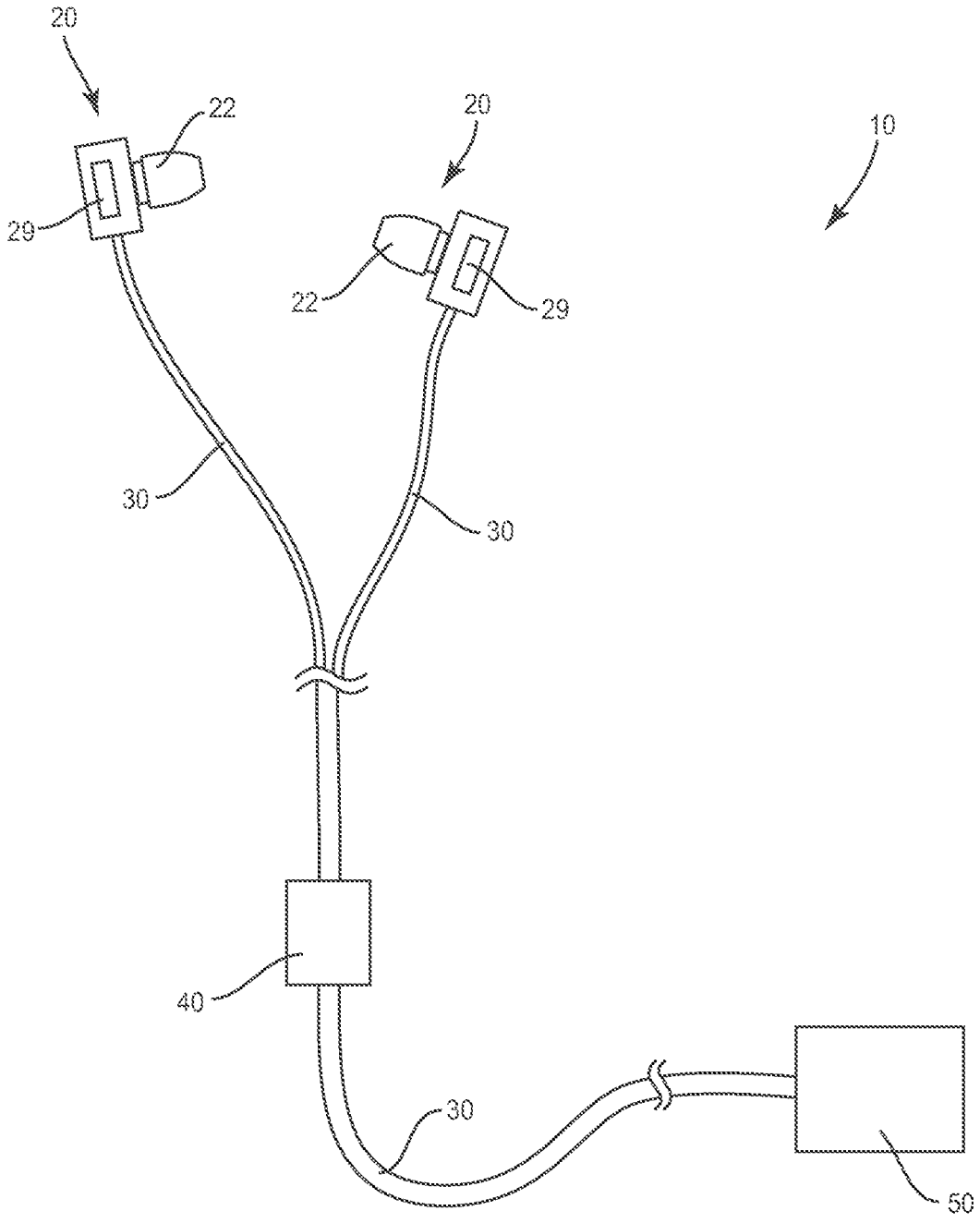
FIG. 1 is a schematic side view of a headset system attached to a generator.

FIG. 1 illustrates a headset system 10 that includes a headset 20, one or more cables 30, and a controller 40 that are configured to receive an audio signal from a source 50. The system 10 is configured to deliver the sound from the sound source 50 through the one or more cables 30 to the user. The headset 20 includes one or more sections that can change in size. The controller 40 includes an input device 44 (see FIG. 6) for a user to adjust the size of the one or more sections.

Figure 5:
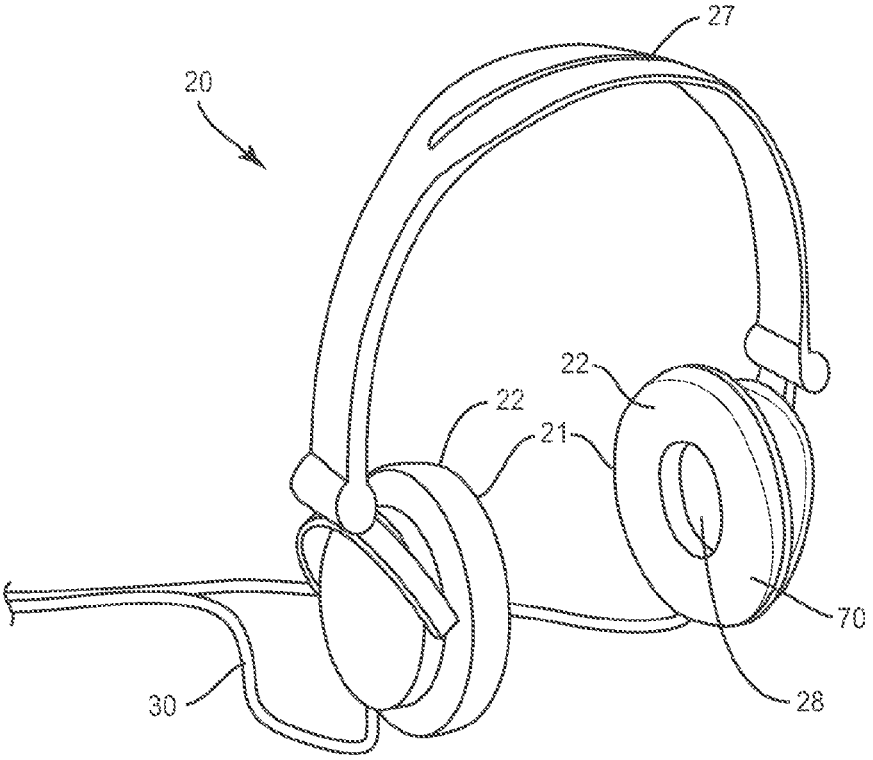
FIG. 5 is a perspective view of a headset and cables.

A variety of different headsets 20 may be part of the headset system 10. Embodiments include but are not limited to an in-ear headset 20 as illustrated in FIG. 1 and an over-ear headset 20 as illustrated in FIG. 5. Embodiments may include a double-earpiece structure with a body for each ear and are able to deliver stereo sound. Embodiments may also include a single-earpiece structure with a single body for just one ear (e.g., monaural headsets).

Figure 2:
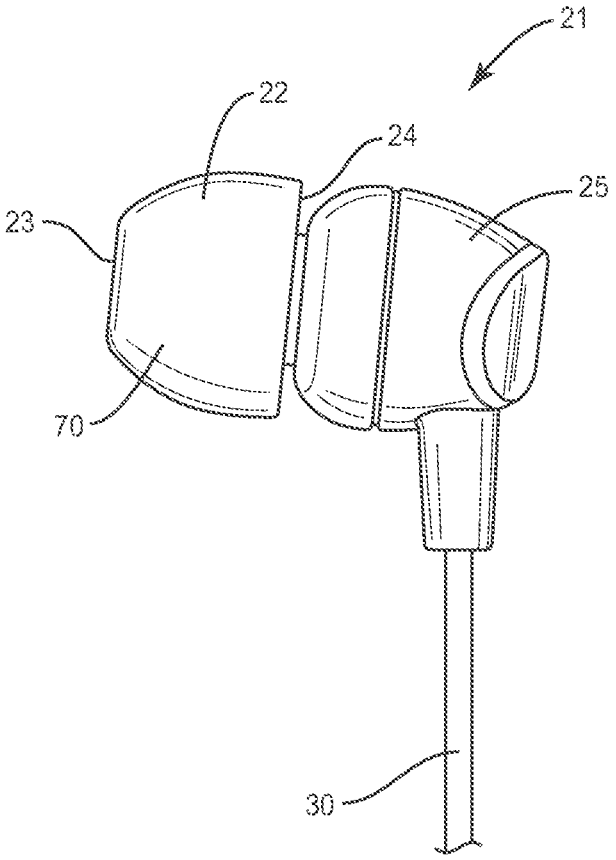
FIG. 2 is a side view of an earpiece and a cable.

FIG. 2 illustrates an earpiece 21 that may be used with another like piece (i.e., a double-earpiece headset) or used individually (i.e., a single-earpiece headset). This type of earpiece 21 is often referred to as an ear bud, in-ear headphone or canalphone because it includes a body 22 sized to fit within the ear canal of the user. The body 22 may include a variety of different shapes and sizes to accommodate the ear canal. The body 22 includes a first distal end 23 that is inserted into the ear canal, and an opposing second proximal end 24. This embodiment includes a tapered shape that narrows from the second end 24 towards the first end 23. The body 22 may also include grooves, or other surface configurations that assist in maintaining the earpiece 21 within the ear canal.

A portion or entirety of the body 22 positioned to contact against the user's ear canal is constructed from an electroactive polymer (EAP) 70. An EAP 70 is a polymer that exhibits a change in size and/or shape when stimulated by an electric field. In one or more embodiments, the EAP is an ionic EAP in which actuation is caused by displacement of ions inside the polymer. An ionic EAP may be actuated with a relative small electric field. Further, it is necessary to apply an electric field to the material to maintain its shape and size. One specific embodiment is an ionic gel. The extent of change in the size of the EAP 70 may vary depending upon the specific material.

The EAP 70 is further quickly responsive to the application of an electric field. In one or more embodiments, the response time is in the low milliseconds. This timing makes the EAP 70 suitable for a variety of different aspects of use in the headset system 10.

The amount of EAP 70 used in the body 22 may vary. In one or more embodiments, the entire body 22 is formed from the EAP 70. Other embodiments may provide for lesser amounts of EAP 70. In these embodiments, a remaining portion of the body 20 may be constructed from a variety of materials, including but not limited to soft silicone, rubber, and plastic. The body 22 may also include two or more different types of EAP 70. These different types may provide for different amounts of expansion. By way of example, a first section of the body 22 may be constructed from a first EAP 70 that expands to about 100% of its original size, and a second section is constructed from a second EAP 70 that expands to about 200% of its original size. The different EAPs 70 may be positioned on the body 22 to facilitate the wearer experience of the user.

Figure 3:
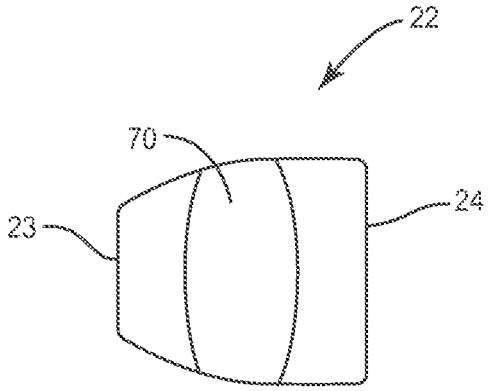
FIG. 3 is a side view of a body of an earpiece.
Figure 4:
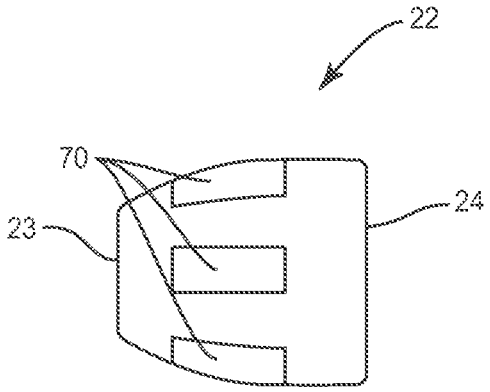
FIG. 4 is a side view of a body of an earpiece.

The EAP 70 is positioned in the body 22 such that it can be felt by the user when it expands and contracts. In one or more embodiments, the EAP 70 is positioned on the exterior and directly contacts against the user. Other embodiments may include one or more layers of different material that extend over the EAP 70. In one specific embodiment, a cover extends over the EAP 70. The position of the EAP 70 on the body 22 may vary depending upon the embodiment. In one embodiment as illustrated in FIG. 2, the entire body 22 is constructed from EAP 70. Other embodiments may include isolated locations of EAP 70. FIG. 3 includes EAP 70 positioned along an isolated strip of the body 22 between the first and second ends 23, 24. FIG. 4 includes the EAP 70 at spaced-apart, discrete sections of the body 22.

One use of the EAP 70 is to increase the size of the body 22 to provide a tighter fit within the ear canal. This increase in size provides for a more effective fit that prevents or reduces the likelihood of the earpiece 20 inadvertently falling out of the user's ear. The user is able to adjust the size to provide for a more comfortable fit. During activation of the EAP 70, one or more dimensions of the body 22 increase. This may include an increase in one or more of the width, length, and height. The change in dimensions may occur throughout an entirety of the body 22, or may occur within specific, isolated sections.

Another use of the EAP 70 is to expand and contract against the user in rhythm with the audio signal to convey a more powerful experience. This use is particularly applicable when the user is listening to music. Again, the body 22 changes in one or more different dimensions such that the user can feel the change and better experience the sound.

The earpiece 21 further includes a housing 25 at the second end 24 of the body 22. The housing 25 may be constructed from a different material than the body 22. In one or more embodiments, the housing 25 is constructed from a rigid material that includes a hollow interior to hold and protect one or more electroacoustic components 29 that convert audio signals emanating from the source 50. The housing 25 also provides a gripping structure to be grasped and manipulated by the user when positioning the earpiece 21 relative to the ear.

FIG. 5 includes an over-the ear headset 20 with the earpieces 21 configured to extend over the ears of the user. Each earpiece 21 includes an annular body 22 that extends around and forms a central opening 28. The opening 28 is sized to fit over the user's ear and is held in position by a band 27. The band 27 applies a compressive force to the bodies 22 to hold their position over the user's ears.

Figure 5A:
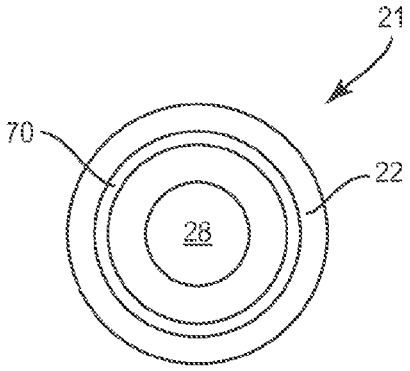
FIG. 5A is an end view of a body of a headset.
Figure 5B:
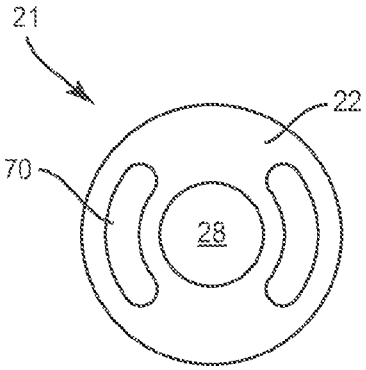
FIG. 5B is an end view of a body of a headset.
Figure 5C:
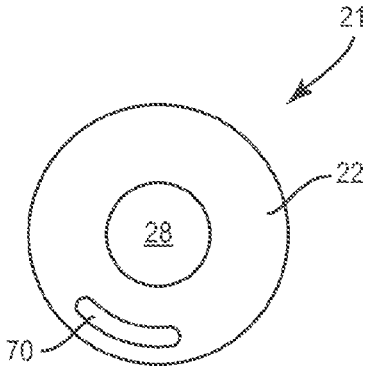
FIG. 5C is an end view of a body of a headset.

A portion or entirety of one or both bodies 22 includes EAP 70. The EAP 70 is positioned to contact against the user when the headset 20 is worn. In one or more embodiments, the EAP 70 directly contacts against the user. In other embodiments, a cover extends around the exterior of the EAP 70. The amount and positioning of the EAP 70 may vary depending upon the specific earpiece 21. FIG. 5 includes the entire body 22 constructed from EAP 70. FIG. 5A includes the EAP 70 shaped as a narrow ring that extends around the central opening 28. FIG. 5B includes the EAP 70 in a pair of discrete sections on opposing sides of the opening 28. FIG. 5C includes a single section of EAP 70. In the various embodiments, the EAP 70 is positioned such that the change in size can be felt by the user.

In the various embodiments, the bodies 22 may each include a single type of EAP 70. Alternatively, two or more different types of EAP 70 may be used for an earpiece 20. In embodiments with multiple discrete EAP sections 70, the sections may be constructed from the same or different EAP material. In the various embodiments that include two earpieces 20, the different earpieces (i.e., left and right earpieces) may include the same or different arrangements of the EAP 70. In one or more embodiments with two earpieces 21, just a single earpiece 21 is equipped with EAP 70.

The headset system 10 includes one or more cables 30 that include one or more conductors to transmit the audio signals from the source 50 to the headset 20. In one or more embodiments, a first section of the cable 30 extends from the controller 40 and is configured to attach with the source 50. The cable 30 may be permanently affixed to the source 50, or may be removably connected such as through a plug at the terminal end of the cable that attaches to a corresponding socket in the source device. A second section of the cable 30 extends between the controller 40 and the headset 20. One or both ends of this section may be permanently or removably attached. In the various embodiments, the cable 30 acts as sheath to cover the various conductors. Further, the cable 30 is constructed with the multiple conductors electrically isolated from each other.

The source 50 produces an audio signal which represents sound, such as music or a human voice that is propagated through the cable 30 to the headset 20. The source 50 may include a variety of devices, including but not limited to CD player, portable media player, cellular communication device, radio, computer, audio amplifier, computing device, hearing aid, and electronic musical instrument.

The controller 40 is positioned along the cable 30 between the source 50 and the headset 20. The controller 40 provides for the user to adjust the EAP 70 on the headset 20 to provide a more comfortable and/or secure fit and/or adjust in step with the input audio signal. The controller 40 may include a rigid exterior housing 49 that protects the interior components. The housing 49 also provides for the controller 40 to be held and manipulated by the user.

Figure 6:
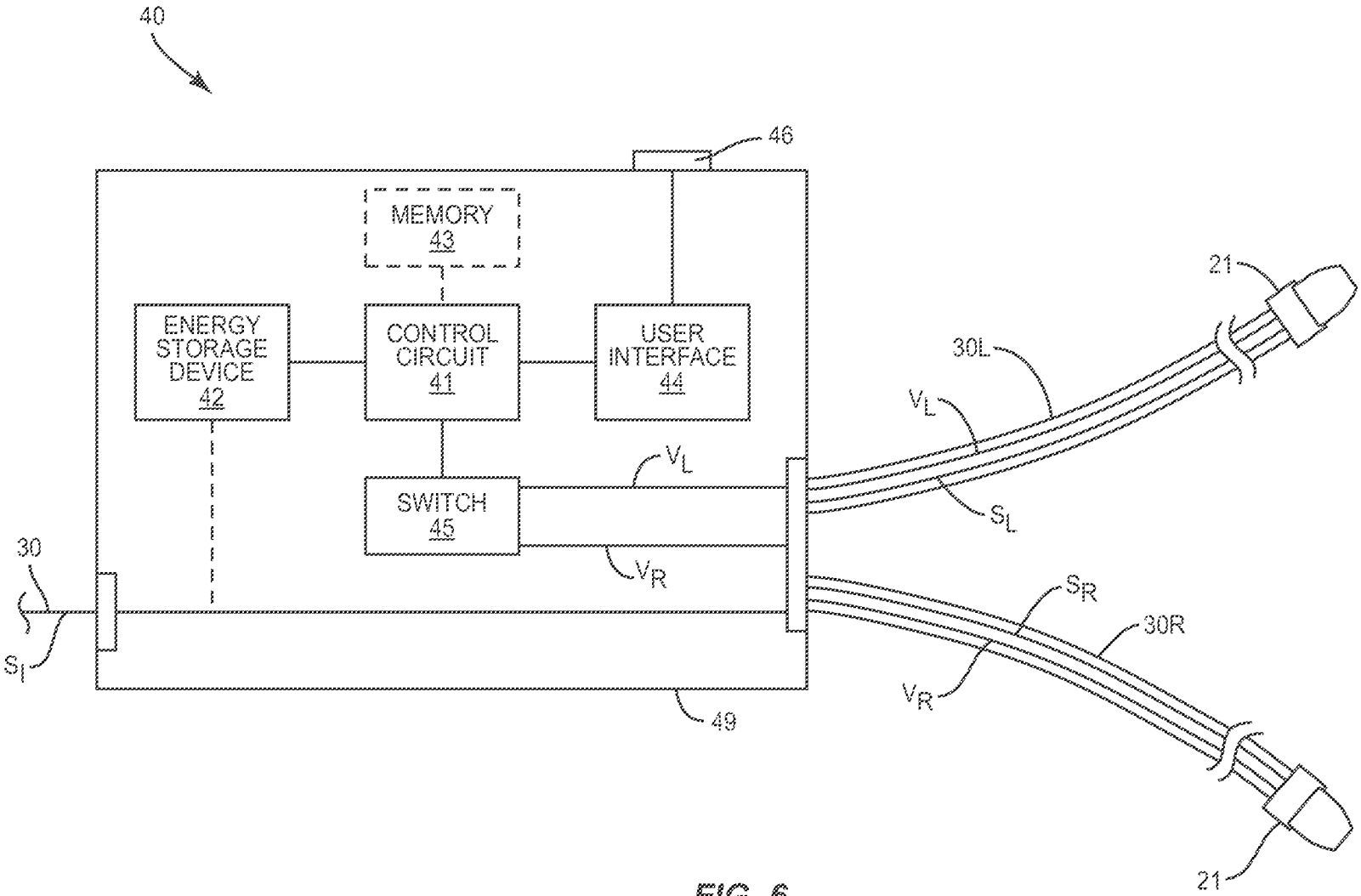
FIG. 6 is a side schematic view of a controller and cables.

FIG. 6 illustrates one embodiment of a controller 40. The controller 40 includes a control circuit 41 that controls the overall operation. The control circuit 41 may include one or more circuits, microcontrollers, microprocessors, hardware, or a combination thereof. In one or more embodiments, a memory circuit 43 is associated with the control circuit 41 and includes a non-transitory computer readable storage medium storing program instructions, such as a computer program product, that configures the control circuit 41 to implement one or more of the techniques discussed herein. Memory circuit 43 may include various memory devices such as, for example, read-only memory, and flash memory. Memory circuit 43 may be a separate component as illustrated in FIG. 6, or may be integrated within the control circuit 41.

Energy storage device 42 is configured to power the components of the controller 40, and also provide an electric field to the EAP 70. In one or more embodiments, the energy storage device 42 includes a battery that may be recharged through an attachable power charger. Another embodiment includes a non-rechargeable battery that may be replaced through a small opening in the housing 49.

The user interface 44 enables a user to adjust the EAP 70, which may include adjusting an overall size of the EAP 70 or the pulsing of the EAP. The main component of the user interface is an input 46 positioned on the exterior of the housing 49 for a user to input their adjustments. The input 46 may include a mechanical switch, one or more input buttons, touch pad, track ball, and other such device for receiving input from the user. The user interface 44 may also include an electronic display.

One or more switches 45 are controlled by the control circuit 41 to introduce an electric field from the energy storage device 42 to the EAP 70. The one or more switches 45 may be configured to be in on or off positions, and may also provide for intermediate settings to supply incremental voltages to be applied to the EAP 70. Voltage loops $V_L$, $V_R$ extend from the switch 45 through the corresponding cable 30L, 30R to supply the voltage the EAP 70 in the corresponding earpieces 21. Output audio signals SL, SR also extend through the cables 30L, 30R to the earpieces 21. In an embodiment with a mono audio input, each of the output audio signals is the same.

Figure 7:
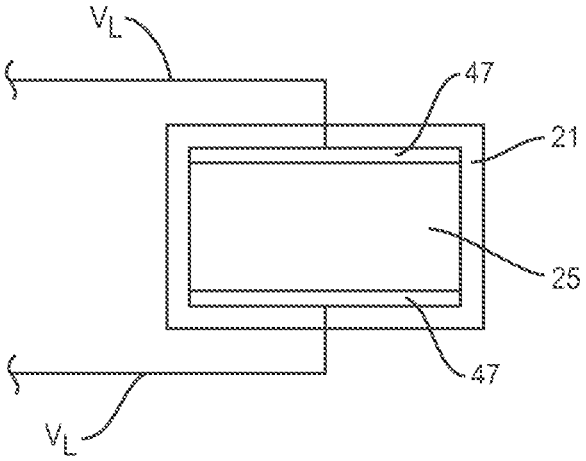
FIG. 7 is a side schematic view of an earpiece with a pair of electrodes and a portion of a voltage loop.

FIG. 7 illustrates the voltage loop $V_L$ for the left earpiece 21. The voltage loop $V_L$ connects to electrodes 47 on opposing sections of the EAP 70. Activation of the switch 45 thus provides for voltage to be applied through the loop $V_L$ to adjust the size of the EAP 70.

The various components of the controller 40 interconnected through the control circuit 41 as illustrated in the embodiment of FIG. 6. By way of example, the energy storage device 42 is connected to the switch 45 through the control circuit 41. The various components may also be directly connected together without the control circuit 41 acting as an intermediary.

The embodiment of FIG. 6 provides for control of the EAP 70 independent of the input audio signal from the source 50. In one or more embodiments, the control circuit 41 includes audio processing functionality and processes the input audio signal $S_I$. However, the functionality does not affect the sizing of the EAP 70.

The controller 40 may further be configured to coordinate movement of the EAP 70 based on a frequency of the audio input signal $S_I$. The EAP 70 may be expanded and contracted based on properties of the input audio signal $S_I$ to provide an enhanced experience when the user is listening to music. In one or more embodiments, the controller 40 is configured to analyze the audio input signal $S_I$. The controller 40 is configured to establish a frequency threshold that may be adjusted by the user through the user interface 44. The controller 40 determines the frequencies below the threshold and activates the EAP 70. This provides a physical feedback to the user through the deformation of the EAP 70. One application is for the EAP 70 to deform corresponding to the beat of music.

Figure 8:
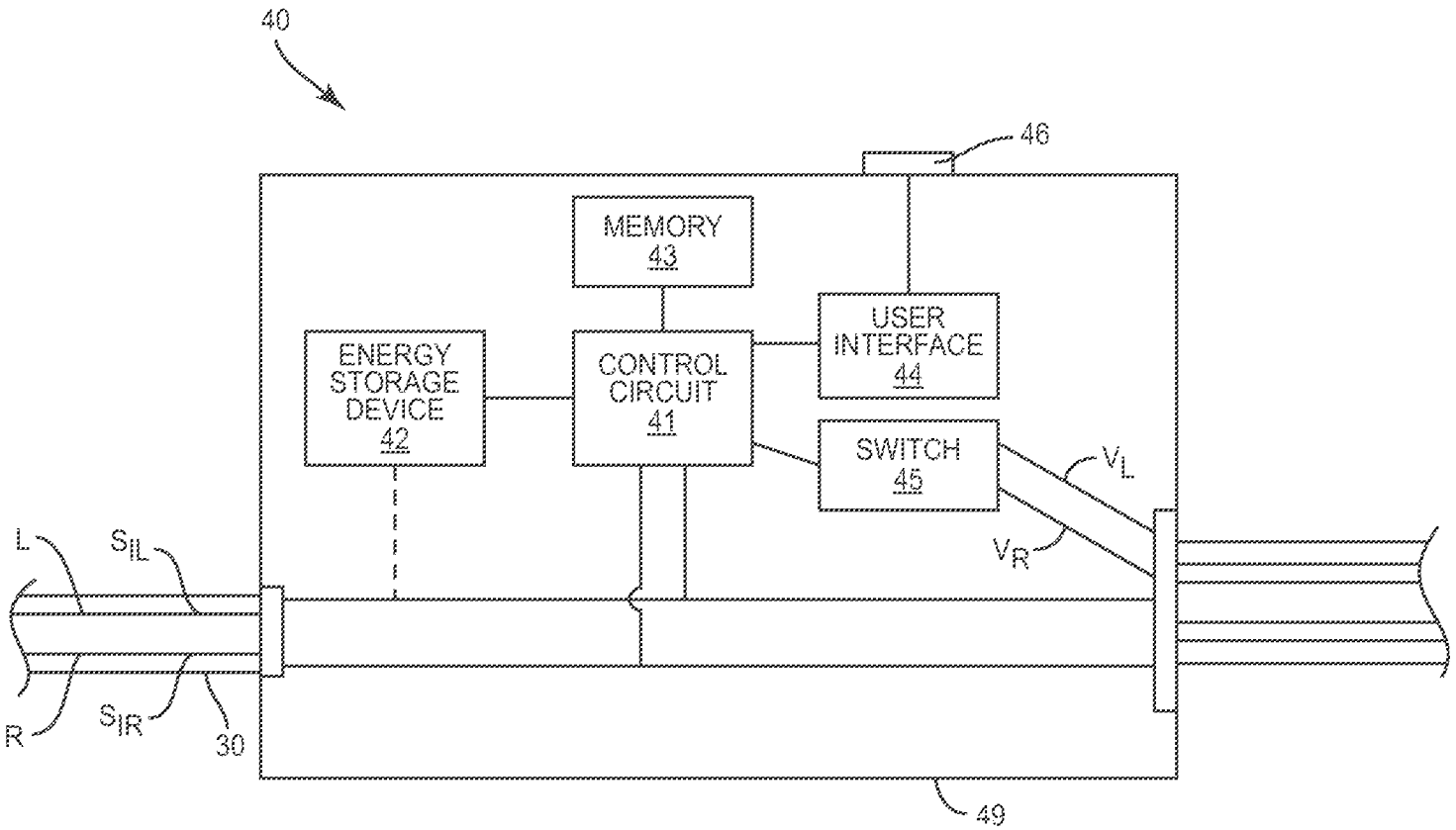
FIG. 8 is a side schematic view of a controller and cables.

FIG. 8 illustrates an embodiment in which the control circuit 41 analyzes the audio input signal $S_I$ and adjusts the EAP 70 accordingly. In this embodiment, the audio input signal $S_I$ includes a right input $S_{IR}$ and a left input $S_{IL}$. The controller 40 includes a control circuit 41, energy storage device 42, user interface 44, and switch 45 similar to those described above for the embodiment of FIG. 6.

The control circuit 41 additionally includes audio processing functionality to analyze the input signals $S_{IR,\ IL}$. In one or more embodiments, the control circuit 41 uses a fast-Fourier transform (FFT) algorithm to convert the audio input signals $S_{IR,\ IL}$ into a frequency domain. Further, the user interface 44 provides for the user to set a frequency threshold for the EAP 70. The control circuit 41 analyzes the audio input and detects frequencies below the threshold. The control circuit 41 then operates the switch 45 to pulse the EAP 70 each time the frequency of the audio input $S_{IL}$ or $S_{IR}$ falls below the set threshold. Thus, voltage loop VL would be activated if input signal $S_{IL}$ fell below the threshold, and voltage loop VR would be activated if input signal $S_{IR}$ fell below the threshold. Alternatively, both of VL and VR could be activated if either $S_{IL}$ or $S_{IR}$ fell below the threshold.

The controller 40 may further be configured to adjust the size of the EAP 70 in both manners: dependent of the input audio and independent of the input audio signal $S_I$. This may include two separate inputs 46 through the user interface 44. A first input 46 may be used to adjust the size of the EAP 70 independently of the audio input signal, such as to adjust a size of the bodies 22 to provide a more comfortable fit. A second input 46 may be used to adjust the frequency threshold to adjust the size of the EAP 70 based on the audio input signal. In one or more embodiments, different EAPs 70 are used for the two different settings. A first EAP 70 is used to adjust the size and a second EAP 70 is used to change the size dependent upon the audio input signal.

FIG. 8 includes the control circuit 41 including the audio processing functionality. In one or more embodiments, a separate audio processing circuit performs this functionality. The separate audio processing circuit may be controlled through the control circuit 41, or may include separate logic to operate autonomously from the control circuit 41.

In the various embodiments, the audio input signal $S_I$ may include a mono input signal or a dual input signal. The controller 40 is configured to operate the EAP 70 for both types of signals. If a mono signal was operated, then both of VL and VR could be activated if the frequency of the corresponding input signal SI fell below the predefined threshold. For a stereo signal having separate SIL and SIR input signals, the voltage loops VL and VR could be separately activated depending on whether their corresponding input signal fell below the predefined threshold. Alternatively, as discussed above, both of VL and VR could be activated if either SIL or SIR fell below the threshold.

Figure 9:
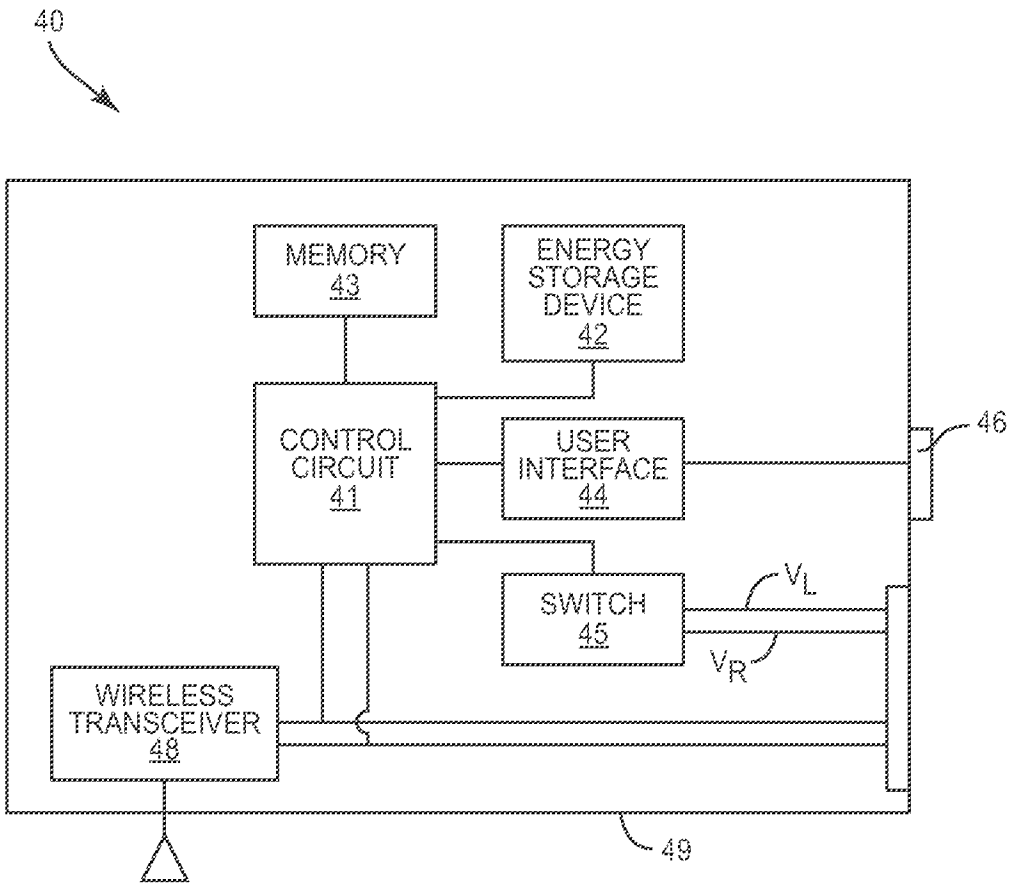
FIG. 9 is a side schematic view of a controller with a wireless transceiver.

The present application may also provide for a wireless functionality. In one or more embodiments, the controller 40 is positioned within the headset 20 or affixed to the headset 20. FIG. 9 illustrates an embodiment that includes a wireless transceiver 48 configured to communicate wirelessly with the source 50. In this embodiment, the audio signals are received through the wireless transceiver 48 (instead of being received through a wired connection via cable 30) and are analyzed by the control circuit 41 in a similar manner as explained above in the embodiment of FIG. 8. Various wireless protocols may be used, such as but not limited to Bluetooth communications.

Another embodiment includes a controller 40 similar to that illustrated in FIG. 6 that is positioned in the headset 20. This embodiment also provides a wireless transceiver and is configured to adjust the EAP 70 independently of the audio input signal.

In one or more embodiments of using the headset system 10, the user initially attaches the cable 30 to the source 50 and places the one or more earpieces 21 in position. This may include inserting the body 22 into or adjacent to the ear canal, or against their head depending upon the type of earpiece 20.

Once positioned, the user can select the desired sizing options. In one or more embodiments in which the sizing is independent of the audio input signal $S_I$, the user adjusts one or more components on the user interface 44 to input the desired sizing. In one or more embodiments, this includes the user manually contacting and depressing or otherwise moving one or more input buttons. This input is received by the control circuit 41, which then activates the one or more switches 45. This provides a voltage from the energy storage device 42 to the EAP 70 along the one or more voltage loops. The electric field causes the EAP 70 to increase to the applicable size. To maintain the increased size, the electric field is maintained on the EAP 70. After the EAP 70 is initially increased, the user may further adjust the one or more components of the user interface 44 to further adjust the size.

When the user has finished or otherwise desires to reduce the size of the one or more earpieces 21, the user may manipulate the user interface 44 to reduce the size of the earpieces 20. In one or more embodiments, controller 40 includes a power switch. The user input results in the voltage being removed resulting in the EAP 70 thus causing a reduction back towards the initial first size. This reduced size may facilitate removal of the body 22 from the ear canal for an inner-ear embodiment.

In one or more embodiments, the user places the one or more earpieces 21 into their ears and inputs a frequency threshold. The controller 40 receives the input and sets the threshold in response. The controller 40 further analyzes the audio input signal $S_I$ and activates the switch 45 thus applying an electric field to the EAP 70 each time the frequency falls below the threshold. The electric field may be maintained for the entirety of the frequency being above the threshold, or may be maintained for a predetermined time period. The switch 45 is then deactivated thus removing the electric field and causing the EAP 70 to reduce in size towards the initial first size. Controlling switch 45 based on the frequency of audio input signal SI, the on-and-off pulsating of the EAP 70 may coincide with a beat of a piece of music. This sizing change augments the user's listening experience, and could even simulate the effects typically exhibited by subwoofers.

The present disclosure may be carried out in other ways than those specifically set forth herein without departing from essential characteristics of the disclosure. The present embodiments are to be considered in all respects as illustrative and not restrictive, and all changes coming within the meaning and equivalency range of the appended claims are intended to be embraced therein.

What is claimed is:

1. A headset system comprising:

an earpiece comprising a body configured to be placed at an ear of a user, the earpiece including an electroactive polymer;

a controller electrically connected to the earpiece, the controller comprising:

a control circuit;

an energy storage device;

an audio processing circuit associated with the control circuit;

an input device configured to receive an input from the user; and a switch operatively connected to the control circuit;

the controller configured to adjust the switch in response to the input received from the input device to selectively use the energy storage device to apply an electrical field to the electroactive polymer to adjust a size of the electroactive polymer between first and second sizes;

the electroactive polymer being adjustable between the first size prior to the application of the electrical field and the second size after the application of the electrical field, the second size being larger than the first size;

the audio processing circuit configured to analyze a frequency of an incoming audio input signal and to activate the switch to apply the electrical field to the electroactive polymer when the audio input signal is below a frequency threshold that is set responsive to the input received through the input device the application of the electrical field increasing the size of the electroactive polymer from the first size to the enlarged second size.

2. The headset system of claim 1, further comprising a wireless transceiver configured to wirelessly receive audio input signals.

3. The headset system of claim 1, wherein the entire body of the earpiece is constructed from the electroactive polymer.

4. The headset system of claim 1, wherein the electroactive polymer is positioned about the earpiece at a plurality of discrete, spaced-apart sections.

5. The headset system of claim 1, further comprising a signal-to-sound converter positioned in the earpiece and configured to convert an audio signal to an internal sound that is audible to the user.

6. The headset system of claim 1, wherein the control circuit is configured to adjust the electroactive polymer to intermediate sizes that are between the first and second sizes.

7. A headset system comprising:

an earpiece comprising a body configured to be placed at an ear of a user, the earpiece including an electroactive polymer positioned on an exterior of the earpiece to contact against the user;

a controller electrically connected to the earpiece, the controller comprising:

a control circuit;

an energy storage device;

an input device configured to receive an input from the user; and a switch operatively connected to the control circuit;

the controller configured to adjust a frequency threshold responsive to the input received through the input device;

the controller configured to analyze a frequency of an incoming audio input signal and to activate the switch to use the energy storage device to apply an electrical field to the electroactive polymer when the audio input signal is below the frequency threshold to increase a size of the electroactive polymer from a first reduced size to an enlarged second size.

8. The headset system of claim 7, wherein the controller is further configured to apply the electrical field to the electroactive polymer responsive to a second input received through the input device to increase the size of the electroactive polymer, the second input being independent from the frequency of the incoming audio signal.

9. The headset system of claim 7, further comprising a wireless transceiver configured to wirelessly receive the incoming audio input signals.

10. The headset system of claim 7, wherein the body of the earpiece is entirely constructed from the electroactive polymer.

11. The headset system of claim 7, wherein the electroactive polymer is positioned about the earpiece at a plurality of discrete, spaced-apart sections.

12. The headset system of claim 7, wherein the control circuit is configured to adjust the electroactive polymer to intermediate sizes that are between the first and second sizes.

* * * * *